United States Patent [19]

Etheridge et al.

[11] Patent Number: 4,845,874

[45] Date of Patent: Jul. 11, 1989

[54] PERCUSSION CAP DISPENSING DEVICE

[76] Inventors: John A. Etheridge, 105 Cherokee Dr., Starkville, Miss. 39759; Thomas W. Hillhouse, Rt. 2, Box 582, Maben, Miss. 39750

[21] Appl. No.: 303,127

[22] Filed: Jan. 30, 1989

[51] Int. Cl.[4] ..... F41C 27/00

[52] U.S. Cl. ..... 42/90

[58] Field of Search ..... 42/90, 87, 83

[56] References Cited

U.S. PATENT DOCUMENTS

| | | | |
|---|---|---|---|
| 3,292,293 | 12/1966 | Chiasera et al. | 42/87 |
| 3,775,889 | 12/1973 | Wilburn | 42/90 |
| 3,992,796 | 11/1976 | Dorgnon | 42/90 |
| 4,550,517 | 11/1985 | Mansfield | 42/90 |

*Primary Examiner*—Charles T. Jordan

*Attorney, Agent, or Firm*—Walter C. Farley

[57] ABSTRACT

A device for storing and applying percussion caps to the nipple of a muzzle-loading firearm includes an elongated sleeve with a loading hole through one side thereof adjacent a first end. A follower member slides within the sleeve and is urged toward the hole by a compression coil spring. A chain extends from the follower through the spring and out of the second end. When the chain is pulled and the spring compressed, percussion caps can be inserted into the device through the hole, forming a row of caps within the sleeve. The caps can then be loaded onto the weapon nipple by pushing the nipple into the hole and extracting a cap, whereupon the next cap becomes available at the hole under the force of the compression coil spring.

3 Claims, 2 Drawing Sheets

PERCUSSION CAP DISPENSING DEVICE

This invention relates to an apparatus for holding and dispensing percussion caps for application to the nipple of a muzzle-loaded weapon.

BACKGROUND OF THE INVENTION

When using a muzzle-loaded weapon, particularly a rifle, in a hunting environment or the like it is necessary to have a supply of percussion caps, along with the powder charge, projectile etc., in order to be able to repeatedly load and use the rifle. Each percussion cap is installed on a nipple which, when the weapon is fired, is struck by a hammer to ignite the charge.

In the relatively recent resurgence of interest in weapons loaded and fired in this manner, a number of devices for holding and releasing the percussion caps have been conceived and a few have appeared on the market. The general objective of all such devices, commonly referred to as "cappers", is to hold a number of percussion caps, perhaps a dozen or so, and to provide some technique for releasing them one at a time so that they can be placed on the nipple.

For various reasons, these cappers have not been totally satisfactory. Some of the disadvantages of cappers presently available are that they contain parts which rattle as one moves, a counter-productive situation when one is hunting. It should be borne in mind that a capper is normally carried by suspending it on a cord placed around one's neck. Some cappers deform the caps when they are pushed out of the magazine. Others have a mechanism for dispensing the caps which can get caught in brush while one is walking through the woods, resulting in dumping the caps onto the ground. If such a capper is carried in one's pocket, the protruding device can catch on the pocket while it is being withdrawn, again dumping the caps. This can be a frustrating situation when one is deep in the woods without a replacement supply.

In other devices, caps can be turned sideways in the magazine so that they are not in the proper position for loading. Cappers also generally require each cap to be hand-fed into a "loading area" prior to their being placed on the nipple of the muzzle loader. This is a difficult task under some circumstances such as when the user's fingers are cold.

SUMMARY OF THE INVENTION

.Accordingly, an object of the present invention is to provide an improved percussion cap carrying and dispensing device which overcomes the disadvantages of the prior art.

In particular, an object of the invention is to provide a device which presents caps, one at a time, at a position from which they can be properly dispensed onto the nipple of the weapon.

A further object is to provide such a device which does not deform or misplace the caps and which has no protruding components to catch on clothing or other objects.

Briefly described, the invention comprises a cap applying device including an elongated rectangular sleeve dimensioned to slidably receive a plurality of percussion caps in a row. A hole extends laterally through one side of the sleeve adjacent one end thereof, the hole being dimensioned so that a single percussion cap at a time can pass therethrough. A plug closes the first end of the sleeve adjacent the hole. A follower member is slidably movable within the sleeve and a chain is coupled at one end to the follower member, the other end of the chain extending out of the other end of the sleeve. A compression coil spring surrounds the chain and extends between the follower member and the second end of the sleeve. Means is provided at the second end of the sleeve for holding the other end of the spring so that when the chain is pulled, the follower member is retracted away from the hole against the force of the spring to permit insertion of caps into the sleeve through the hole, forming a line of caps between the plug and the follower member. When the chain is released, the spring urges the follower member against the line of caps toward the hole, positioning the last-loaded cap at the hole in position for application to a nipple, after which the next cap is so positioned.

BRIEF DESCRIPTION OF THE DRAWINGS

In order to impart full understanding of the manner in which the foregoing and other objects are achieved in accordance with the invention, a particularly advantageous embodiment thereof will be described with reference to the accompanying drawings, which form a part of this specification, and wherein.

DETAILED DESCRIPTION OF THE PREFERRED EMBODIMENT

Figure 1:
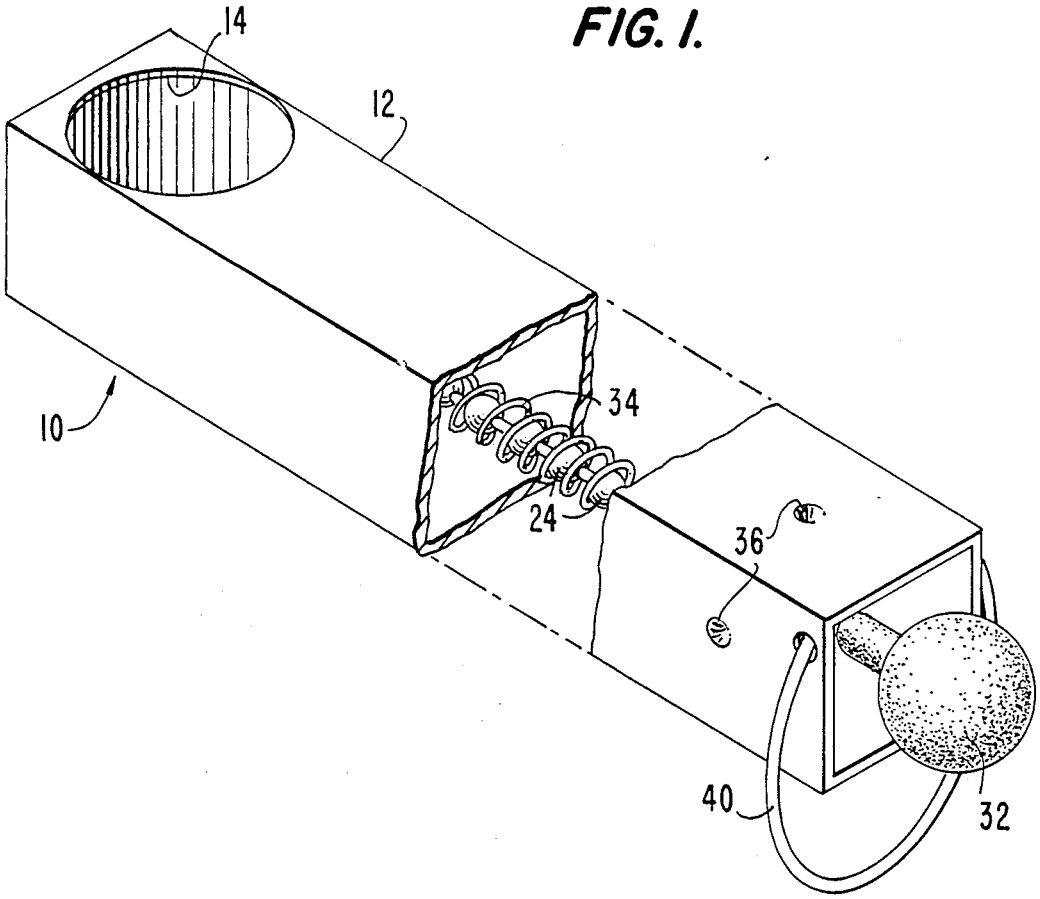
FIG. 1 is a foreshortened and enlarged perspective view of a dispensing device in accordance with the invention.

As shown in FIG. 1, the device of the present invention, which will be referred to as a capper indicated generally at 10, includes an elongated rectangular sleeve 12 which is dimensioned to receive a plurality of percussion caps. As will be readily recognized by those skilled in this art, the drawings of the device are somewhat enlarged in order to show the details of the structure, the actual device being approximately $\frac{1}{4}$ in. on a side and being about 4 in. in total length. These dimensions can, of course, be altered to suit percussion caps of different sizes.

Figure 2:
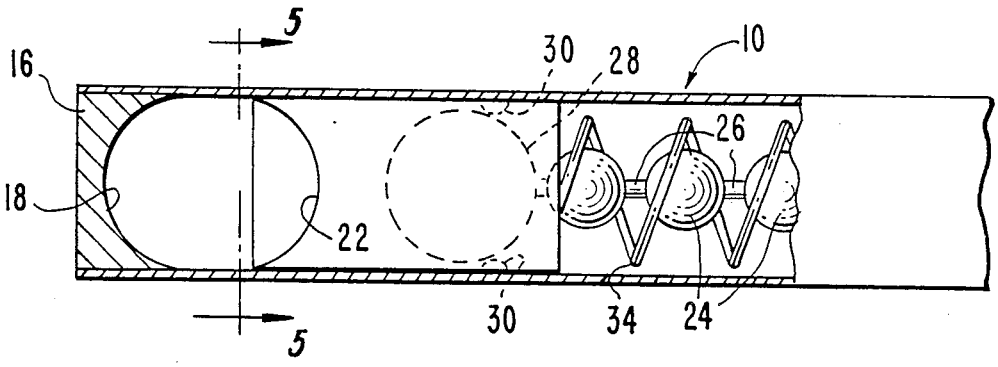
FIG. 2 is a partial top plan view, partially cut away, of a first end of the dispensing device of FIG. 1.

At the first, dispensing, end of sleeve 12 is a circular hole 14 extending through the wall of the sleeve which will be referred to as the top, for convenience only. The first end of the sleeve, as best seen in FIG. 2, is closed by a plug 16 which is welded or glued in the end of the sleeve. The inner surface of plug 16 has a curved surface 18 which has a radius of curvature substantially equal to that of hole 14, the surface and the hole having substantially the same center so that the edge of the hole flows smoothly into the surface to the extent mechanically possible.

Figure 4:
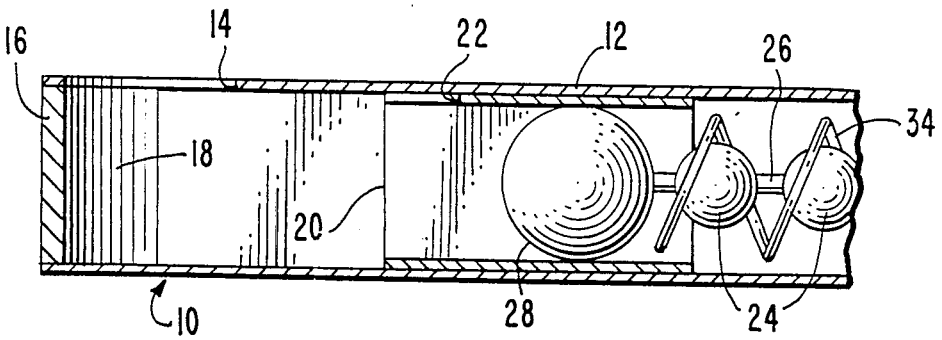
FIG. 4 is a partial side elevation, in section, of the first end of the dispensing device of FIGS. 1–3.

Within sleeve 12 is a follower member 20 which is also formed as a rectangular hollow tubular sleeve but is slightly smaller than sleeve 12 so as to be slidably movable within sleeve 12. As will be seen in FIGS. 2 and 4, follower member 20 is also somewhat shorter than the sleeve. At the end of follower member 20 which faces hole 14 and plug 16, the "top" surface of the follower member is provided with a semicircular cut 22 which, again, has a radius which is substantially the same as the radius of hole 14. The radius of hole 14, surface 18 and cut 22 are all substantially equal to the radius of the percussion caps which are to be loaded into the device and dispensed therefrom.

A bead chain extends longitudinally within sleeve 12 from the follower to the other end of the sleeve which will be referred to as the second end. The bead chain is a conventional chain consisting of a series of sheet-metal balls 24 interconnected by small wire links 26, a kind of chain which is commonly used to actuate electrical light switches and for many other purposes. As will be recognized from the following discussion, the functions of this chain can be performed by other devices such as a link chain, a flexible wire, or, conceivably, a length of string. However, the characteristics of the bead chain are preferred and the term "chain" will be used herein to include any such device.

Figure 3:
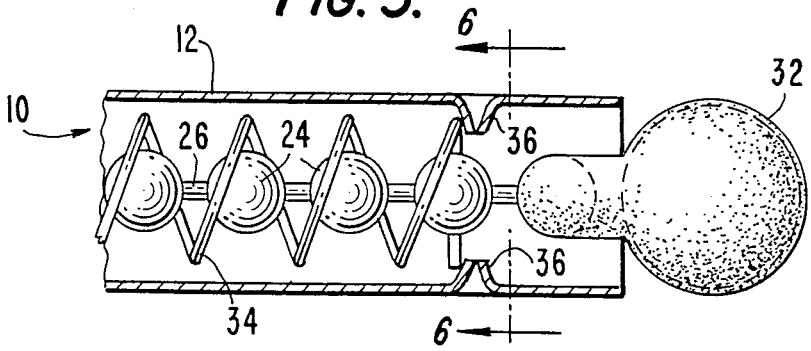
FIG. 3 is a partial top plan view, in partial section, of the second end of the dispensing device of FIG. 1.
Figure 5:
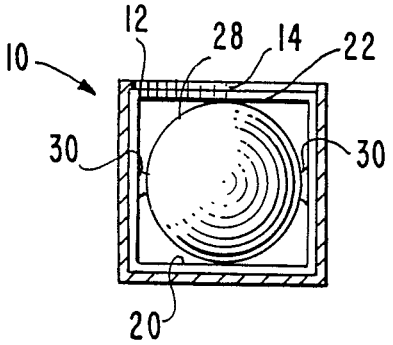
FIG. 5 is a transverse sectional view along line 5—5 of FIG. 2.

At one end of chain 24 is an enlarged bead 28 which is inside of follower 20 and is retained therein by inwardly protruding dimples 30 which are formed in the sides of follower member 20 by deforming the material thereof inwardly as by striking with a sharp implement. Dimples 30 are visible in FIGS. 2 and 5. Chain 24 extends from the follower the full length of the sleeve and out of the second end of the sleeve as illustrated in FIGS. 1 and 3. At the open end of the sleeve, the chain is provided with a second enlarged bead 32, preferably a bead which is too large to enter the end of sleeve 12. Conveniently, the enlarged bead 32 and the first bead of the chain itself are coated with a brightly colored plastic material so that they form an easily visible and easily graspable handle with which to pull the chain through the sleeve.

Figure 6:
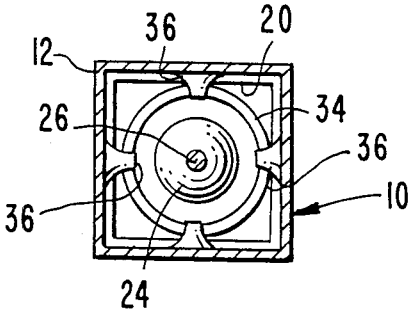
FIG. 6 is a transverse sectional view along line 6—6 of FIG. 3.

A compression coil spring 34 is also provided within sleeve 12, the spring surrounding the chain and extending between the follower member and a location near the second end of sleeve 12. A plurality of depressions or dimples 36 are formed in all four sides of sleeve 12 adjacent the second end to provide a location against which the end of the spring can be held. The other end of the spring is held in the follower by abutment against dimples 30. Thus, when the end 32 of chain 24 is pulled, bead 28 abuts dimples 30, causing the follower to move toward the second end and compressing spring 34 between dimples 30 and inwardly protruding portions 36. The protruding portions 36 are also visible in FIG. 6 along with spring 34.

Finally, adjacent the second end of sleeve 12 is a lanyard ring 40 which passes through holes in sleeve 12 and can be attached to a lanyard for suspending the device around the user's neck.

Although the manner of use of the device in accordance with the invention should be clear from the foregoing, the functions will be summarized. To load the device of the invention with percussion caps, bead 32 is pulled away from the sleeve to draw follower 20 away from hole 14, compressing spring 34. Caps are inserted, one at a time, through hole 14. As will be recognized by those familiar with this art, the caps are generally cylindrical bodies and must be inserted on the nipple in an axial direction. Thus, the caps are placed, one at a time, through hole 14 and allowed to follow the follower, sliding down the inside of sleeve 12, until the spring is essentially fully compressed and the desired number of caps has been placed in the sleeve. Bead 32 is then released, allowing the spring 34 to urge follower 20 against the first cap installed in the sleeve. At that point, the last cap installed in the sleeve is pressed against surface 18 and is aligned with hole 14 in a position to be loaded on the nipple of the weapon.

To load the nipple, one simply inserts the nipple through hole 14, allowing the nipple to engage the first available cap. Device 10 is then pulled away from the nipple, leaving the cap on the nipple, and allowing the next cap to move to the loading position behind hole 14. During the loading process, it may be desirable to exert slight force on bead 30 to remove some of the force of spring 34 from the cap being extracted. Upon release of the bead, the spring urges the next cap into position.

The device described herein should be made from a material which is non-corrosive, does not interact with the material of the caps and which is capable of retaining its shape and dimensions under a variety of environmental conditions which are likely to be encountered during hunting or competition. Brass is a suitable material for these purposes and is capable of being deformed to form nipples 30 and protruding portions 36 without difficulty. However, other materials can be used without departing from the scope and concept of the invention.

While one advantageous embodiment has been described in detail, it will be recognized by those skilled in the art that various changes and modifications can be made therein without departing from the scope of the invention as defined by the appended claims.

What is claimed is:

1. A device for storing and applying percussion caps to a muzzle-loading firearm of the type having a nipple, the device comprising an elongated rectangular sleeve dimensioned to slidably receive a plurality of percussion caps in a row;

means defining a hole extending laterally through one side of said sleeve adjacent a first end thereof, said hole being dimensioned so that a single percussion cap at a time can pass therethrough;

a plug closing said first end adjacent said hole;

a follower member slidably movable longitudinally within said sleeve;

a chain coupled at one end to said follower member, the other end of said chain extending out of the other, second, end of said sleeve;

a compression coil spring surrounding said chain and extending between said follower member and said second end of said sleeve; and means at said second end of said sleeve abutting the adjacent end of said spring, whereby pulling said chain through said second end retracts said follower member away from said hole against the force of said spring to permit insertion of caps into said sleeve through said hole, forming a line of caps between said plug and said follower member, and whereby releasing said chain allows said spring to urge said follower member toward said hole, positioning one cap at said hole and holding it at that position for application to a nipple, whereupon the next cap is so positioned.

2. A device according to claim 1 wherein said plug has a curved surface facing inwardly toward said follower member, the curvature of said surface having substantially the same radius as said hole and being substantially concentric therewith.

3. A device according to claim 2 wherein said chain is a bead chain having a plurality of beads of generally uniform size interconnected by link members and having enlarged beads at the ends thereof, one of said large beads being too large to enter said second end of said sleeve and the other bead engaging said follower member.

* * * * *